US010835433B2

(12) United States Patent
Schwab et al.

(10) Patent No.: US 10,835,433 B2
(45) Date of Patent: Nov. 17, 2020

(54) ASSISTIVE APPARATUS WITH ROTATABLE GRAB BAR

(71) Applicant: Brian Schwab, Each Chatham, NY (US)

(72) Inventors: Brian Schwab, Each Chatham, NY (US); Cheng-Yang Lai, Taipei (TW)

( * ) Notice: Subject to any disclaimer, the term of this patent is extended or adjusted under 35 U.S.C. 154(b) by 0 days.

(21) Appl. No.: 16/581,749

(22) Filed: Sep. 24, 2019

(65) Prior Publication Data

US 2020/0093672 A1 Mar. 26, 2020

Related U.S. Application Data

(60) Provisional application No. 62/736,660, filed on Sep. 26, 2018.

(51) Int. Cl.
*A61G 7/10* (2006.01)
*A47K 17/02* (2006.01)

(52) U.S. Cl.
CPC ..... *A61G 7/1007* (2013.01); *A47K 17/02* (2013.01); *A47K 17/028* (2013.01); *A61G 7/1038* (2013.01)

(58) Field of Classification Search
CPC .... A47K 17/02; A47K 17/026; A47K 17/028; A47K 13/005; A61G 7/1007; A61G 7/1038
USPC ..... 135/65, 67; 5/81.1 R; 482/66; 4/254, 4/667; 297/411.21, 411.3, 423.37
See application file for complete search history.

(56) References Cited

U.S. PATENT DOCUMENTS

| | | | | |
|---|---|---|---|---|
| 2,905,187 | A * | 9/1959 | Croce | A45B 17/00 135/20.1 |
| 4,144,597 | A * | 3/1979 | Guenther | E03D 11/135 297/411.31 |
| 4,685,157 | A * | 8/1987 | James | A47K 17/026 4/254 |
| 4,932,090 | A * | 6/1990 | Johansson | A47K 17/024 5/662 |
| 5,920,917 | A * | 7/1999 | Landsberger | A47K 13/26 4/235 |
| 8,936,033 | B2 * | 1/2015 | Velarde | A61H 3/00 135/67 |
| 2003/0178053 | A1 * | 9/2003 | Wilensky | A61H 3/00 135/67 |
| 2005/0066430 | A1 * | 3/2005 | Bly | A47K 17/026 4/254 |
| 2015/0113719 | A1 * | 4/2015 | Good | A47K 17/028 4/254 |

FOREIGN PATENT DOCUMENTS

| | | | | |
|---|---|---|---|---|
| CA | 2482605 | A1 * | 3/2005 | A47K 17/026 |
| EP | 624357 | A1 * | 11/1994 | A47K 17/026 |
| JP | 10113311 | A * | 5/1998 | A47K 17/026 |
| JP | 10234623 | A * | 9/1998 | A47K 17/026 |

* cited by examiner

*Primary Examiner* — Robert Canfield
(74) *Attorney, Agent, or Firm* — Michael D. Eisenberg

(57) ABSTRACT

An assistive apparatus is disclosed that solves the problem of conventional toilet seats lacking proper support for individuals and safety assistance. The assistive apparatus provides a rotatable grab bar assisting users in getting up or sitting on a toilet. Also, the grab bar can be attached with a foldaway handle which allows user to pull themselves up easily.

13 Claims, 15 Drawing Sheets

ASSISTIVE APPARATUS WITH ROTATABLE GRAB BAR

BACKGROUND OF THE INVENTION

Embodiments of the present invention generally relate to an assistive apparatus with rotatable grab bars, a support frame, a supporting leg assembly, and a grab bar assembly.

DESCRIPTION OF THE RELATED ART

Conventionally, toilet seats lacking proper support for individuals and safety assistance. An assistive apparatus is disclosed that provides safety rails and other modern assistive apparatus for toilets.

SUMMARY OF THE INVENTION

The present invention generally an assistive apparatus and a method of using the assistive apparatus. The assistive apparatus includes a support frame mounting base; a supporting leg assembly comprising two front support; two or more upper support; and two knobs connected to the support frame mounting base via one or more base support; a grab bar assembly comprising two grab bars connected to any one of the two or more upper support of the supporting leg assembly, wherein the one or more grab bar is capable of rotating in 360 degrees at a horizontal plane; a front bar connected to one or more knobs, wherein the one or more knobs are adapted to adjust the width consist with the extension of the supporting leg assembly.

A method of using the assistive apparatus includes holding the grab bars or the foldaway handles to assist in getting up or sitting on a toilet.

In one embodiment, the support frame mounting base is connected between the supporting leg assembly and any sitting apparatus to be used, where the support frame mounting base is adapted to connect supporting leg assembly via knobs. In one aspect, the support frame mounting base is adapted to connect the sitting apparatus to be used at a stationary direction; in another aspect, the support frame mounting base is adapted to support the supporting leg assembly at a vertical position.

In another embodiment, the supporting leg assembly includes two front support; two or more upper support; and two or more knobs connected to the support frame mounting base via one or more base support. In one aspect, the two or more knobs are adapted to adjust the height of the two or more front between a first place ("$H_0$") to a second place ("$H_1$"); In another aspect, the two or more knobs are adapted to adjust the length of the two or more upper support between a first place ("$L_0$") at a horizontal position to a second place ("$L_1$").

In still another embodiment the supporting leg assembly further comprising that the two or more knobs adapted to adjust the height of the two or more front support two or more knobs are adapted to adjust the height of the two or more front support at a vertical position; and the two or more knobs are adapted to adjust the length of the two or more upper support at a horizontal position.

In yet another embodiment, the grab bar assembly comprising two grab bars, wherein the two grab bars are connected to any one of the two or more upper support of the supporting leg assembly. In one aspect, the one or more grab bar is capable of rotating in 360 degrees at a horizontal plane. In another aspect, the supporting leg assembly is adapted to support the one or more grab bars.

In a further embodiment, the assistive apparatus further includes the front bar connected to a knob, wherein the knob is adapted to adjust the width consist with the extension of the supporting leg assembly. In one aspect, the knob is adapted to adjust the width between a first place ("$W_0$") to a second place ("$W_1$").

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention includes an assistive apparatus for elderly or disabled people to use. The assistive apparatus can be placed directly over a rim of a toilet or other device, and includes a rotatable grab bar to assist users in getting up or sitting on the toilet. Also the grab bar can be attached with a foldaway handle which allows user to pull themselves up easily. So that the assistive apparatus with rotatable grab bar allows the individual to hold the grab bars to sit on or get up from a toilet, or transfer to a toilet from a wheel chair, or keep body stable while using a toilet.

The assistive apparatus as described in detail below can accommodates elderly or disabled people to a sitting apparatus is provided; When an individual person uses a sitting apparatus coupled with the assistive apparatus described herein, the grab bar is rotatable, the foldaway handle is capable of folding, the individual person can be supported, the position can be adjusted, thereby aiding elderly or disabled people to use a sitting apparatus is provided. In addition, the assistive apparatus is equipped with a supporting leg assembly; a grab bar assembly, and a foldaway handle assembly to be placed on any kinds of sitting apparatus.

Figure 1:
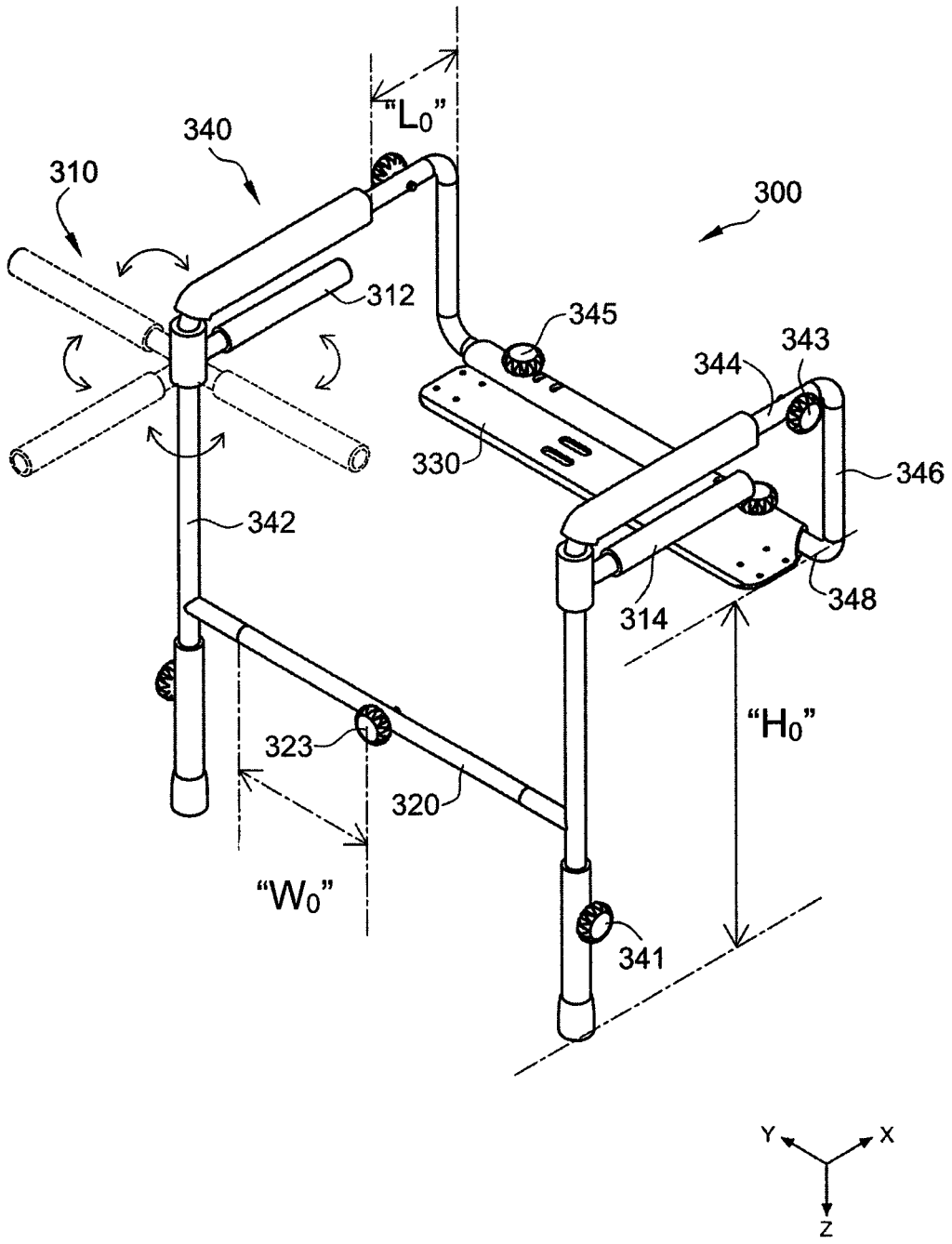
FIG. 1 is a perspective view of one example of an assistive apparatus having an operating a rotatable grab bar adapted to rotate in 360 degrees at a horizontal plane, wherein a supporting leg assembly at a preset position (e.g., at $L_0$, $H_0$, and $W_0$) according to another embodiment of the invention.

FIG. 1 illustrates one embodiment of an assistive apparatus 300, which generally includes a support frame mounting base 330, a supporting leg assembly 340 and a grab bar assembly 310. The supporting leg assembly 340 comprising two front supports 342; two upper support 344, two rear support 346, two base support 348 and a front bar 320 provides means for adjusting length, height and width. In one example, the assistive apparatus 300 can be placed over a toilet wherein the toilet having a toilet base 220 and a toilet bowl 210. The toilet can be any of a conventional toilet, commonly found in residential, commercial, and institutional environments.

In one embodiment, as shown in FIG. 1, the support frame mounting base 330 is connected between the supporting leg assembly 340 and any sitting apparatus to be used, where the support frame mounting base 330 is adapted to connect supporting leg assembly 340. In another embodiment, the supporting leg assembly 340 includes two front support 342, two or more upper support 344, and two or more knobs 343 connected to the support frame mounting base via one or more base support 348.

In yet another embodiment, the front bar 320 connected to a knob 323, wherein the knob 323 is adapted to adjust the width consist with the extension of the supporting leg assembly 340.

In still another embodiment, as shown in FIG. 1, the grab bar assembly 310 comprises two grab bars 312,314 connected to the upper support 344 of the supporting leg assembly 340 on both sides. In one aspect, the comprises two grab bars 312 & 314 are capable of rotating in 360 degrees at a horizontal plane.

For example, the two grab bars 312 & 314 could be rotated clockwise and counterclockwise so as to aid the individual to adjust the bar to a desired a position while using the sitting apparatus.

In yet another embodiment, the supporting leg assembly 340 is adapted to support the one or more grab bars 312 & 314.

In this figure, the dimensions of the assistive apparatus 300 is at the minimum level. The preset height from the support frame mounting base 330 to the ground is "$H_0$". The preset distance between the right front support 342 and the knob 323 is "$W_0$". And the preset length between the rear support 346 and the soft cushion 347 is "$L_0$".

Figure 2:
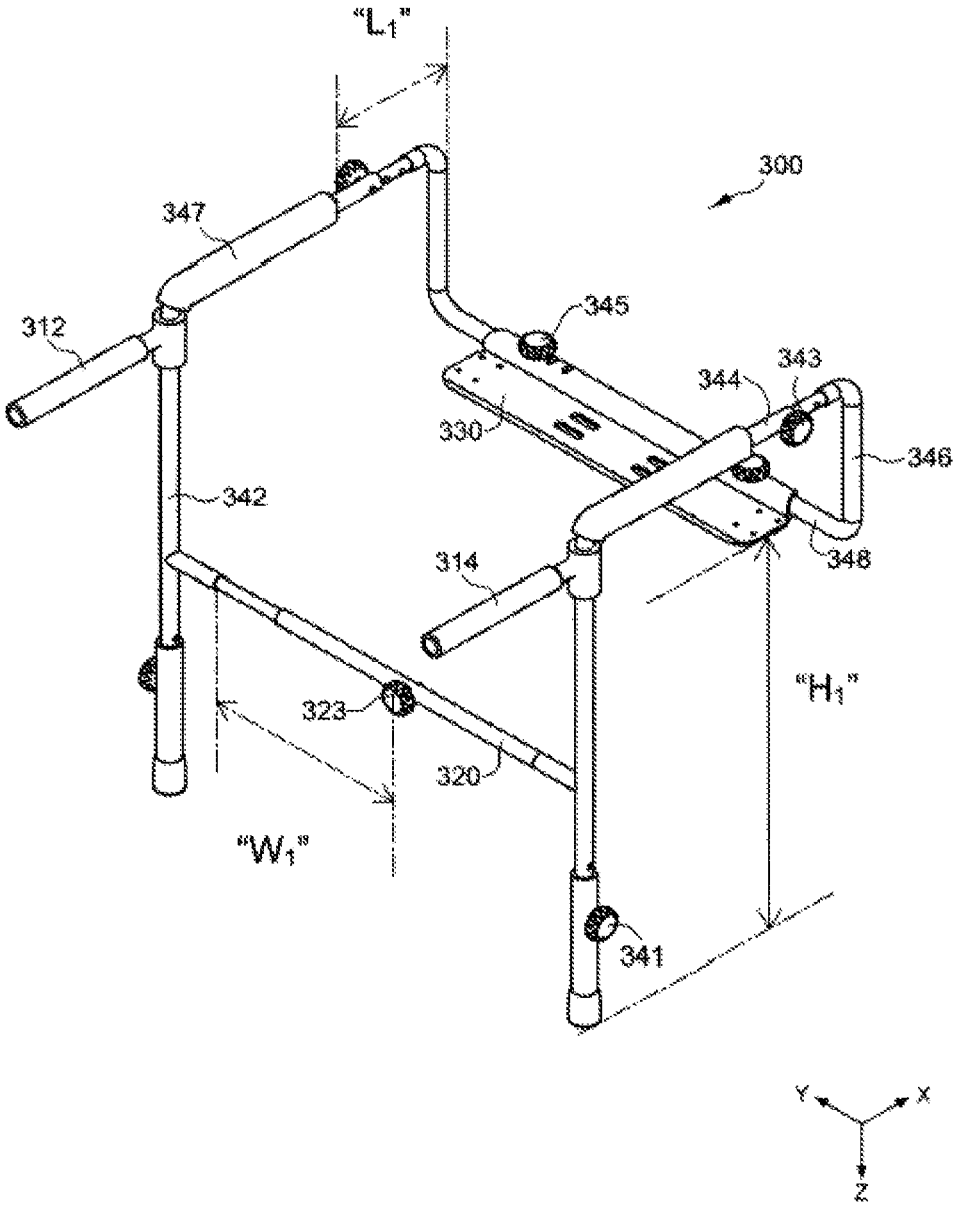
FIG. 2 is a perspective view of another example of an assistive apparatus with rotatable grab bar, wherein a supporting leg assembly at a desired position (e.g., at $L_1$, $H_1$, and $W_1$) according in one position to the one embodiment of the invention shown in an extend state

FIG. 2 illustrate a perspective view of the assistive apparatus 300 of the present invention is shown in an extended state. While individual use the assistive apparatus 300, the grab bar assembly 310, supporting leg assembly 340, knob 323, knob 341, knob 343, and knob 345 are adapted to adjust and extend the assistive apparatus 300 to a desired position at length, height and width direction.

In this figure, the dimensions of the assistive apparatus 300 is at the maximum level. The height from the support frame mounting base 330 to the ground is "$H_1$". The distance between the right front support 342 and the knob 323 is "$W_1$". And the length between the rear support 346 and the soft cushion 347 is "$L_1$".

In one embodiment, as shown in FIG. 2, the knob 323 and 345 are adapted to adjust the width between a first place ("$W_0$") to a second place ("$W_1$"); the knob 343 is adapted to adjust the length between a first place ("$L_0$") to a second place ("$L_1$"); the knob 342 is adapted to adjust the height between a first place ("$H_0$") to a second place ("$H_1$").

Figure 3A:
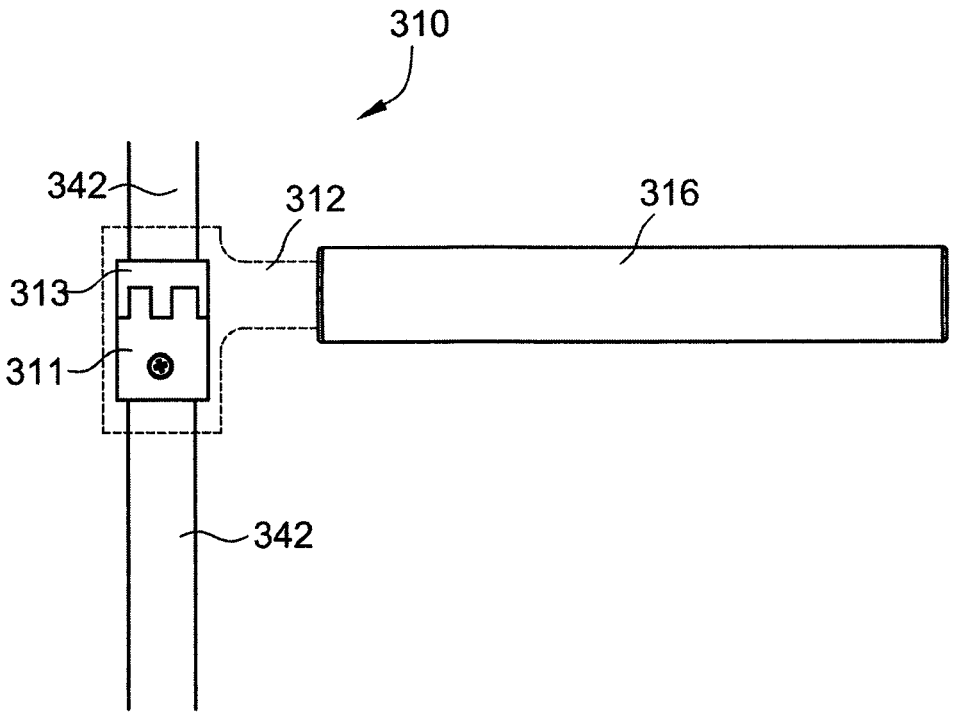
FIG. 3A is a sectional side view of one example of a grab bar assembly capable of rotating according to still another embodiment of the invention.

FIG. 3A illustrate a sectional side view of the grab bar assembly 310 comprising castellated collar 311, a bar 312, a castellated nut 313, and a grip cushion 316. The castellated collar 311 is secured on the front support 342 with a screw, and jointed with the castellated nut 313 which is attached in the bar 312.

In one embodiment, as shown in FIG. 3A, the grab bar assembly 310 includes castellated collar 311, a bar 312, and a castellated nut 313, wherein the three elements accommodate together to provide horizontal and vertical support. For example, an individual person may use the grab bar assembly 310 by lifting and moving the bar 312, it could be easily adjusted between a first place and second place up to 360 degrees at a horizontal position. Thus, provide the needed support for the purpose of aiding elderly or disabled people.

Figure 3B:
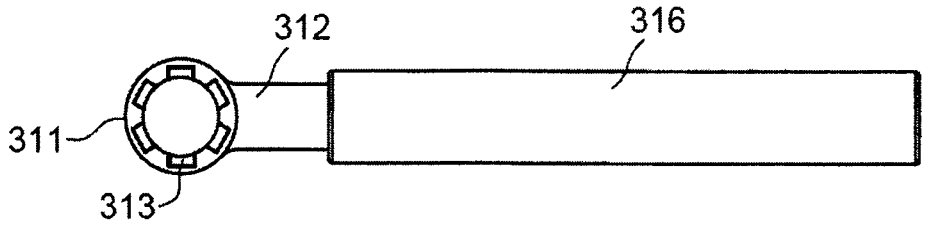
FIG. 3B is a sectional top view of another example of a grab bar assembly capable of rotating according to still another embodiment of the invention.

FIG. 3B illustrates a sectional top view of the grab bar assembly 310 comprising castellated collar 311, a bar 312, a castellated nut 313, and a grip cushion 316. The castellated collar 311 is secured with the castellated nut 313 which is attached in the bar 312.

In another embodiment, as shown in FIG. 3B, the grab bar assembly 310 includes castellated collar 311, a bar 312, and a castellated nut 313, wherein the three elements accommodate together to provide horizontal and vertical support. For example, an individual person may use the grab bar assembly 310 by lifting and moving the bar 312, it could be easily adjusted between a first place and second place up to 360 degrees at a horizontal position. Thus, provide the needed support for the purpose of aiding elderly or disabled people.

Figure 4A:
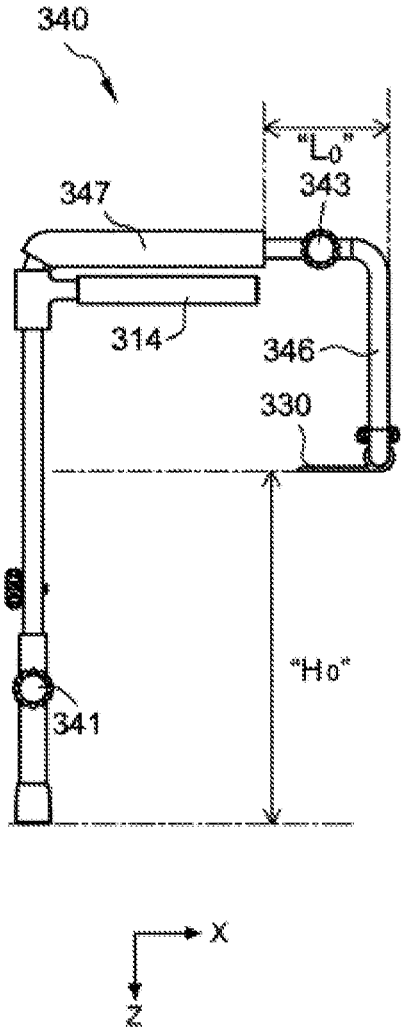
FIG. 4A is a side view of one example of an assistive apparatus having a rotatable grab bar, wherein the front support and upper support at a preset position (e.g., at $L_0$, and $H_0$) according to still another embodiment of the invention.

FIG. 4A illustrates a side view of the assistive apparatus 300 comprising a rotatable grab bar 314, wherein the front support 342 and upper support 344 at a preset position (e.g., at $L_0$, and $H_0$) according to one embodiment of the invention. For example, one individual person could adjust the height, the user may remove the knob 341 so as to extend the front support 342. Once the desired height is determined, the user may stick the knob 341 back in the front support 342 as a lock.

The assistive apparatus 300 can accommodate different length from "$L_0$" to "$L_1$". For example, one individual person could adjust the length, the user may remove the knob 343 so as to extend the upper support 344. Once the desired length is determined, the user may stick the knob 343 back in the upper support 344 as a lock.

Figure 4B:
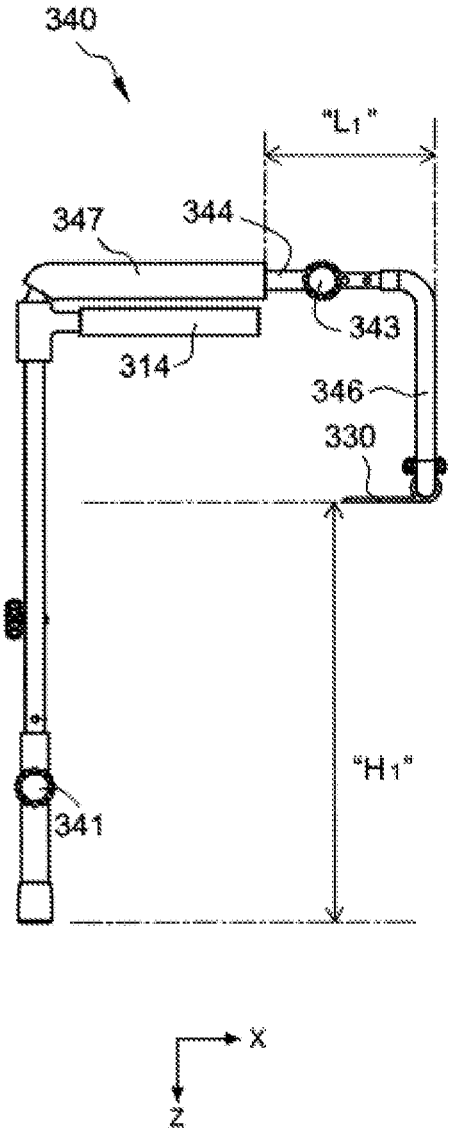
FIG. 4B is a side view of another example of an assistive apparatus with rotatable grab bar, wherein the front support and upper support at a desired position (e.g., at $L_1$, and $H_1$) according to yet another embodiment of the invention.

FIG. 4B illustrates a side view of the assistive apparatus 300 comprising a rotatable grab bar 314, wherein the front support 342 and upper support 344 at a desired position (e.g., at $L_1$, and $H_1$) according to another embodiment of the invention. For example, one individual person could adjust the height, the user may remove the knob 341 so as to extend the front support 342. Once the desired height is determined, the user may stick the knob 341 back in the front support 342 as a lock.

The assistive apparatus 300 can accommodate different length from "$L_0$" to "$L_1$". For example, one individual person could adjust the length, the user may remove the knob 343 so as to extend the upper support 344. Once the desired length is determined, the user may stick the knob 343 back in the upper support 344 as a lock.

Figure 4C:
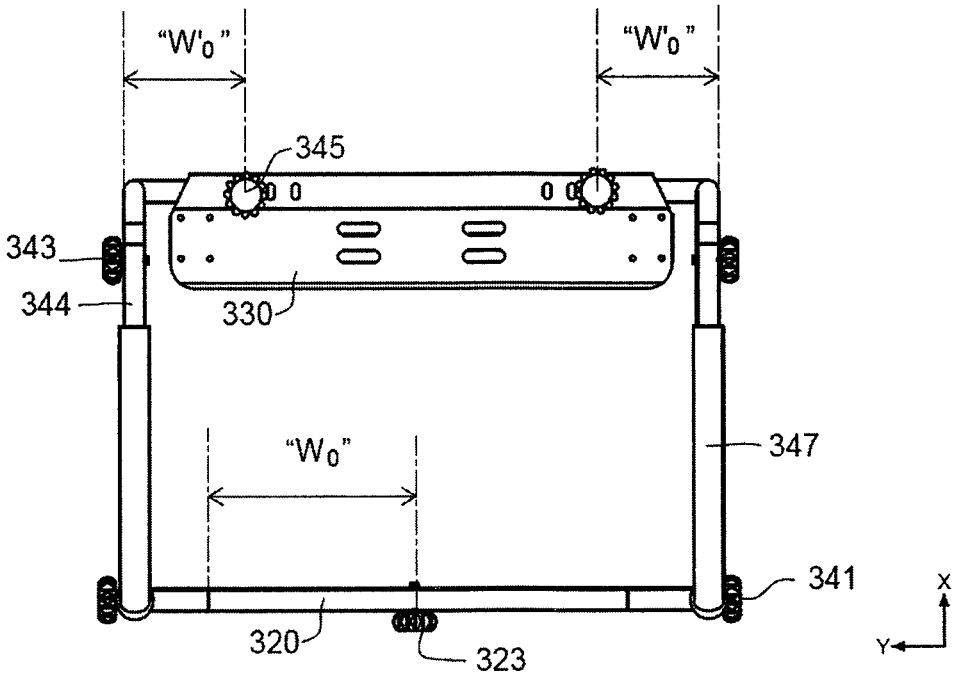
FIG. 4C is a top view of still another example of an assistive apparatus with rotatable grab bar, wherein the rear support at a preset position (e.g., at $W_0$) according to yet another embodiment of the invention.

FIG. 4C illustrate a top view of still another example of an assistive apparatus 300 with rotatable grab bar assembly 310, wherein the rear support 346 at a preset position (e.g., at $W_0$) according to yet another embodiment of the invention. The assistive apparatus 300 can accommodate different width from "$W_0$" to "$W_1$" for user's body type.

In one embodiment, As shown in FIG. 4C, the distance between a knob 345 and the upper support 344 is "$W_0$" when there is no any extension on the width. The increased distance from "$W_0$" to "$W_1$" is equivalent to the increased distance from "$W_0$" to "$W_1$"

Figure 4D:
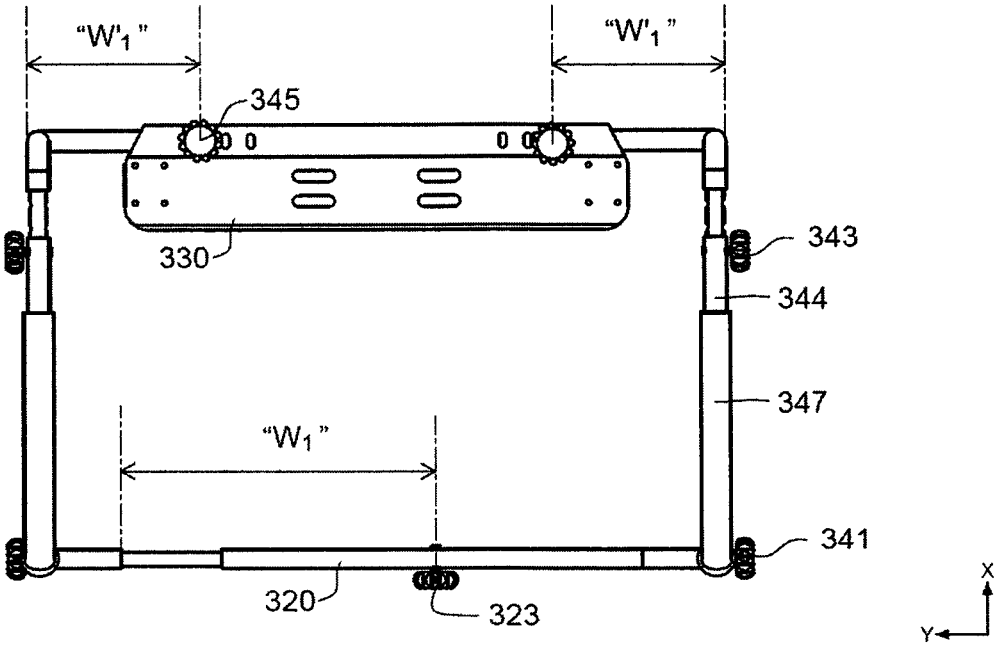
FIG. 4D is a top view of a further example of an assistive apparatus with rotatable grab bar, wherein the rear support at a desired position (e.g., at $W_1$) according to another embodiment of the invention.

FIG. 4D illustrate a top view of a further example of an assistive apparatus 300 with rotatable grab bar assembly 310, wherein the rear support 346 at a desired position (e.g., at $W_1$) according to another embodiment of the invention. The assistive apparatus 300 can accommodate different width from "$W_0$" to "$W_1$" for user's body type.

In one embodiment, as shown in FIG. 4D, the width of the assistive apparatus 300 is extended at the maximum level and the distance between a knob 345 and the upper support 344 is "$W_1$". The increased distance from "$W_0$" to "$W_1$" is equivalent to the increased distance from "$W_0$" to "$W_1$".

Figure 4E:
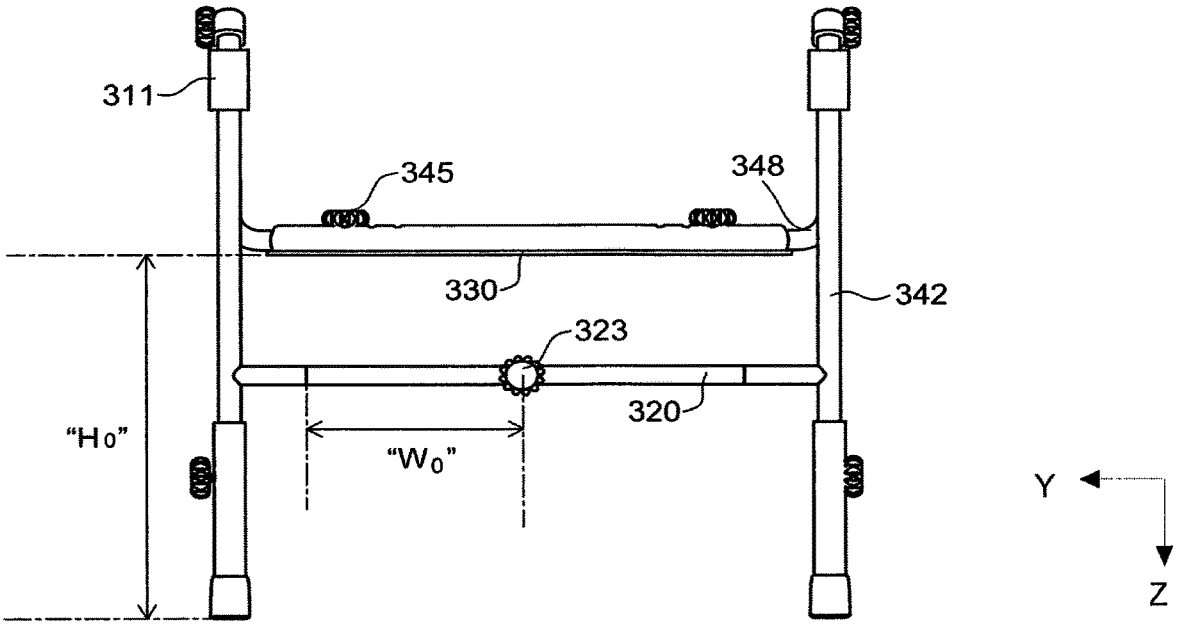
FIG. 4E is a front view of another example of an assistive apparatus with rotatable grab bar, wherein the rear support and front support at a preset position (e.g., at $W_0$, and $H_0$) according to another embodiment of the invention.

FIG. 4E illustrates a front view of another example of an assistive apparatus 300 with rotatable grab bar assembly 310, wherein the rear support 346 and front support 342 at a preset position (e.g., at $W_0$, and $H_0$) according to another embodiment of the invention. In one embodiment, as shown in FIG. 4E, adjust the width between a first place ("$W_0$") to a second place ("$W_1$"). In another embodiment, as shown in FIG. 4E, adjust the height between a first place ("$H_0$") to a second place ("$H_1$").

For example, an individual person may adjust the width by removing the knob 323 and knob 345 so as to extend the front support 342 and the front bar 320. Once the desired width is determined, the user may stick the knob 323 and the knob 345 back to secure the frame. In addition, an individual person may adjust the height by removing the knob 341 extend the front support 342. Once the desired height is determined, the user may stick the knob 341 back to secure the frame.

Figure 4F:
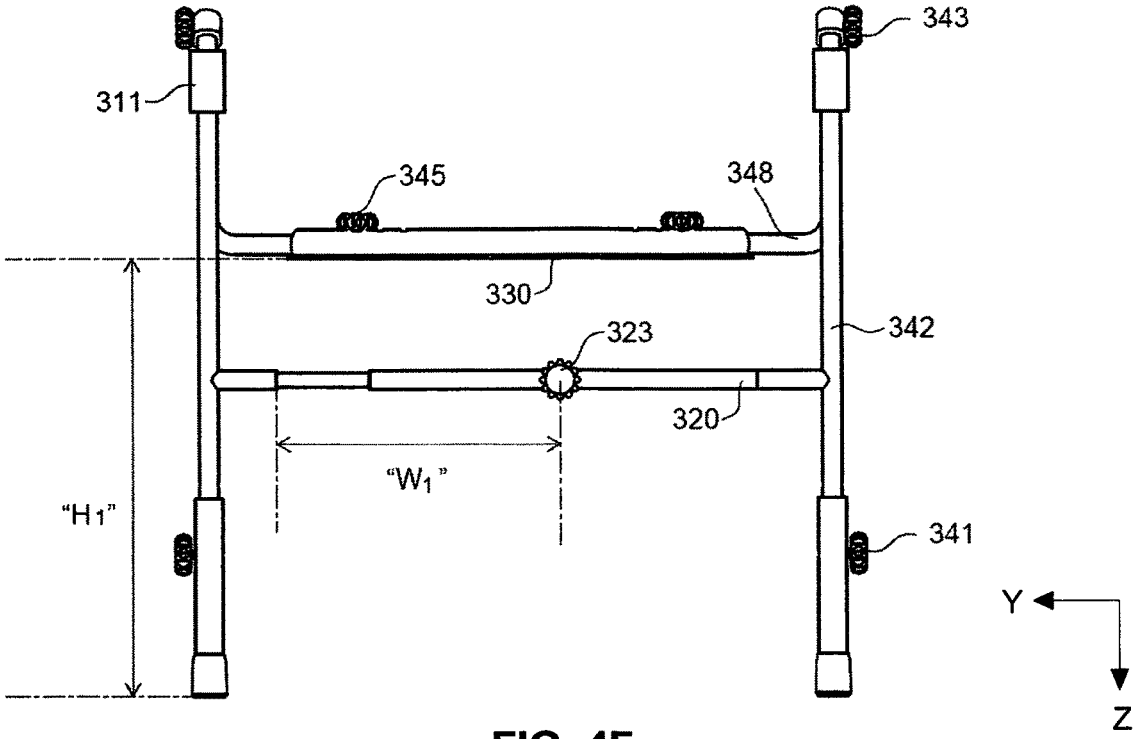
FIG. 4F is a front view of still another example of an assistive apparatus with rotatable grab bar, wherein the rear support and front support at a desired position (e.g., at $W_1$, and $H_1$) according to another embodiment of the invention.

FIG. 4F illustrates a front view of still another example of an assistive apparatus 300 with rotatable grab bar assembly 310, wherein the rear support 346 and front support 342 at a desired position (e.g., at $W_1$, and $H_1$) according to another embodiment of the invention. In one embodiment, as shown in FIG. 4E, adjust the width between a first place ("$W_0$") to a second place ("$W_1$"). In another embodiment, as shown in FIG. 4E, adjust the height between a first place ("$H_0$") to a second place ("$H_1$").

For example, an individual person may adjust the width by removing the knob 323 and knob 345 so as to extend the front support 342 and the front bar 320. Once the desired width is determined, the user may stick the knob 323 and the knob 345 back to secure the frame. In addition, an individual person may adjust the height by removing the knob 341 extend the front support 342. Once the desired height is determined, the user may stick the knob 341 back to secure the frame.

Figure 5:
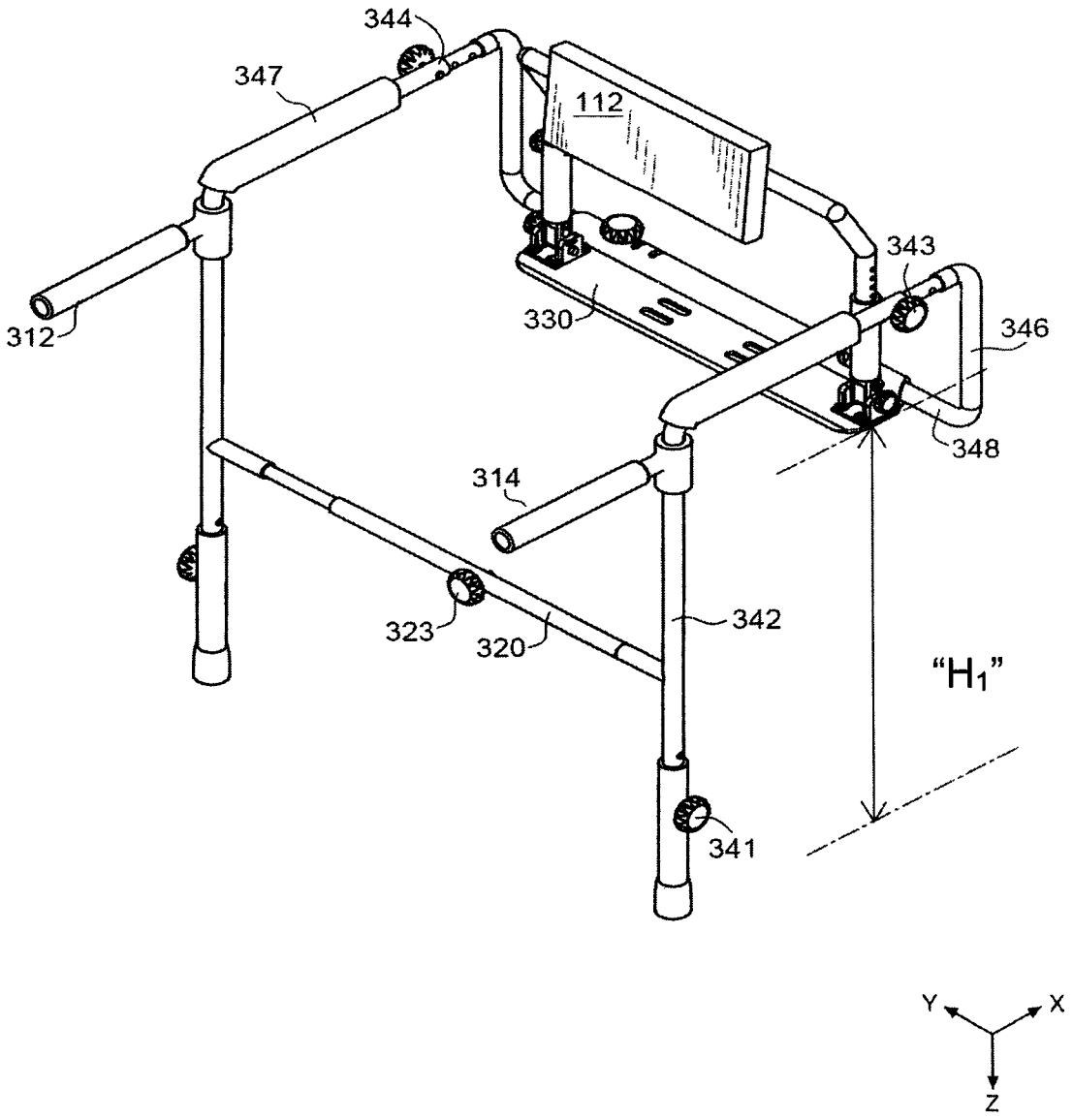
FIG. 5 is a perspective view of one example of an assistive apparatus with back rest according to one embodiment of the invention.

FIG. 5 illustrates a perspective view of one example of an assistive apparatus 300 with back rest 112, wherein the front support 342 at a desired position (e.g., at $H_1$) according to one embodiment of the invention. The knob 342 is adapted to adjust the height between a first place ("$H_0$") to a second place ("$H_1$")

In one embodiment, as shown in FIG. 5, the back rest 112 is attached on the support frame mounting base 330 and serves as an adjustable back support. For example, an individual person may use the back rest 112 to support a human back, wherein the back rest is designed to relieve pressure on the back by adjusting it for different positions.

Figure 6:
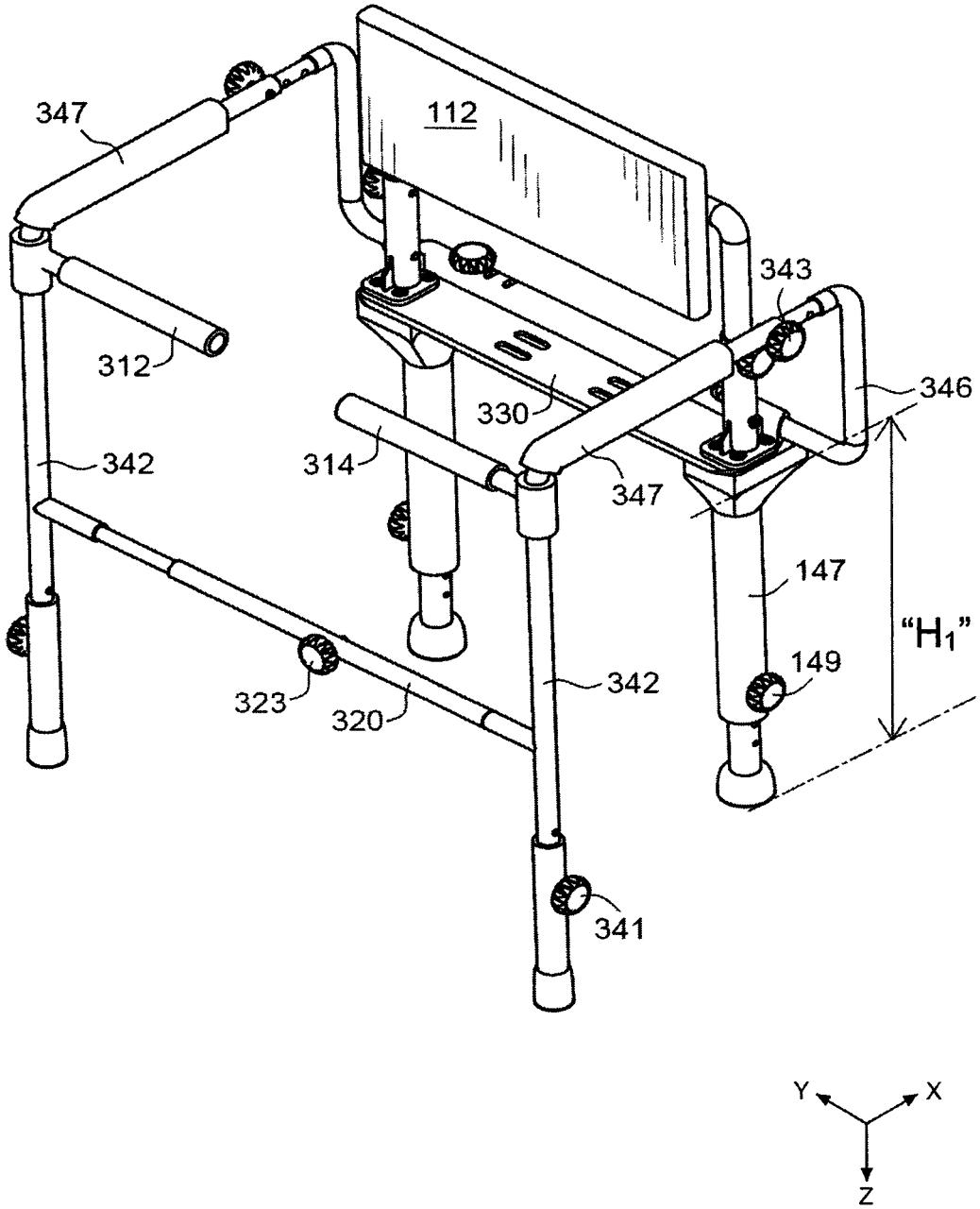
FIG. 6 is a perspective view of one example of the assistive apparatus with back rest and back supporting legs, wherein the front support and back supporting legs at a desired position (e.g., at $H_1$) according to one embodiment of the invention.

FIG. 6 illustrates a perspective view of one example of the assistive apparatus 300 with back rest 112 and back supporting legs 147, wherein the front support 342 and back supporting legs 147 at a desired position (e.g., at $H_1$) according to one embodiment of the invention. The knob 342 is adapted to adjust the height between a first place ("$H_0$") to a second place ("$H_1$").

In one embodiment, as shown in FIG. 6, the assistive apparatus 300 may further be assembled as an assistive model comprising two back supporting legs 147 and a back rest 112. For example, an individual person may adjust the height of the back supporting leg 147 via a knob 149. The back supporting leg 147 increases the weight capacity of the assistive apparatus 300 for elderly or disable users.

Figure 7:
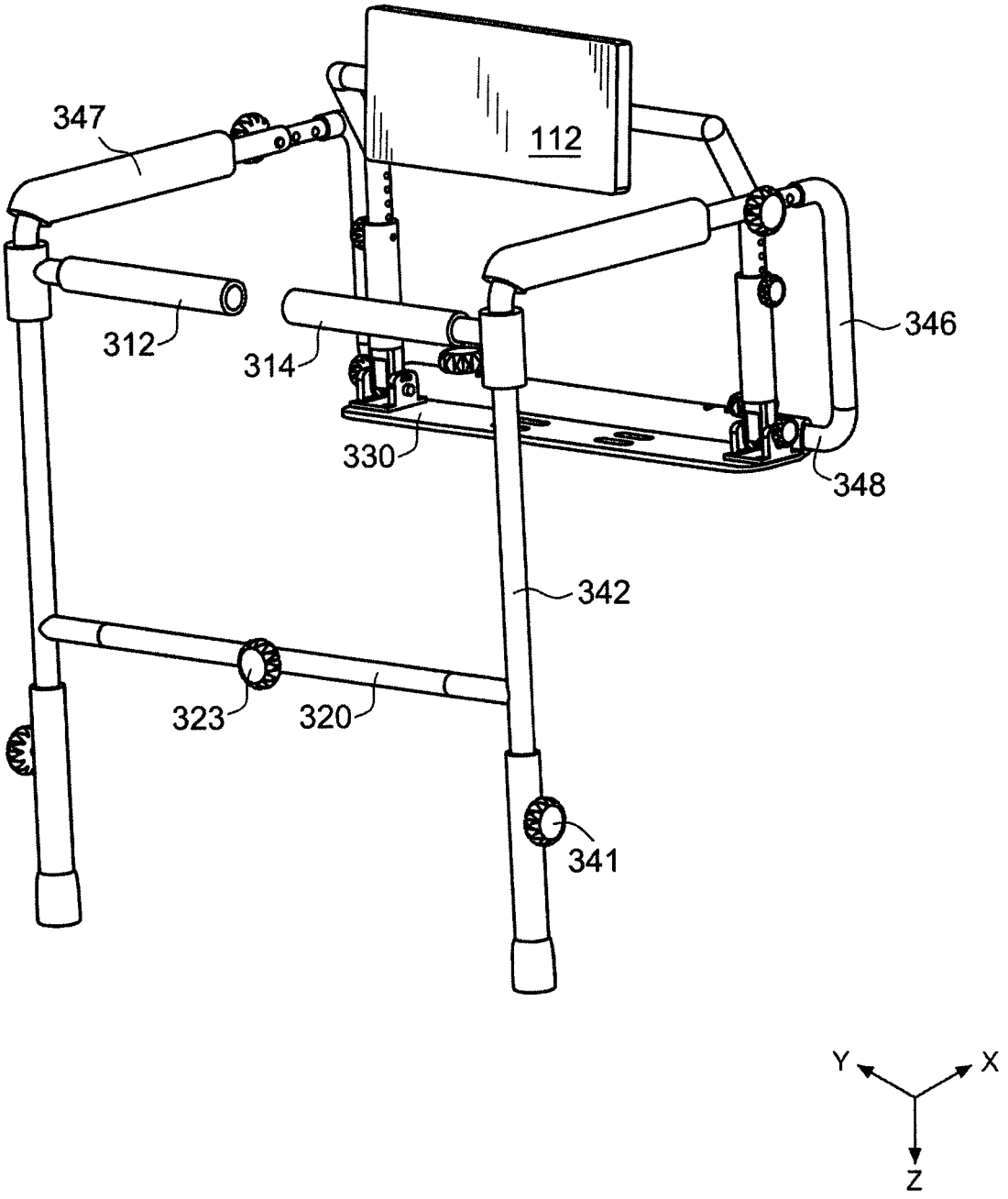
FIG. 7 is a perspective view of another example of the assistive apparatus with back rest according to another embodiment of the invention.

FIG. 7 illustrates a perspective view of the assistive apparatus 300 with rotatable grab bar assembly 310 of the present invention and the back rest 112 is shown.

In one embodiment, as shown in FIG. 7, the left bar 314 and right bar 312 are at a position consistent with the front 320. The left bar 314 and right bar 312 are capable of rotating in 360 degrees at a horizontal position. Further, the back rest 112 is attached on the support frame mounting base 330 and serves as an adjustable back support.

For example, an individual person may operate the grab bar assembly 310 from a first place to a second place up to 360 degrees to provide horizontal support or vertical support for elderly or disable users. In addition, an individual person may use the back rest 112 to support a human back, wherein the back rest is designed to relieve pressure on the back by adjusting it for different positions.

Figure 8:
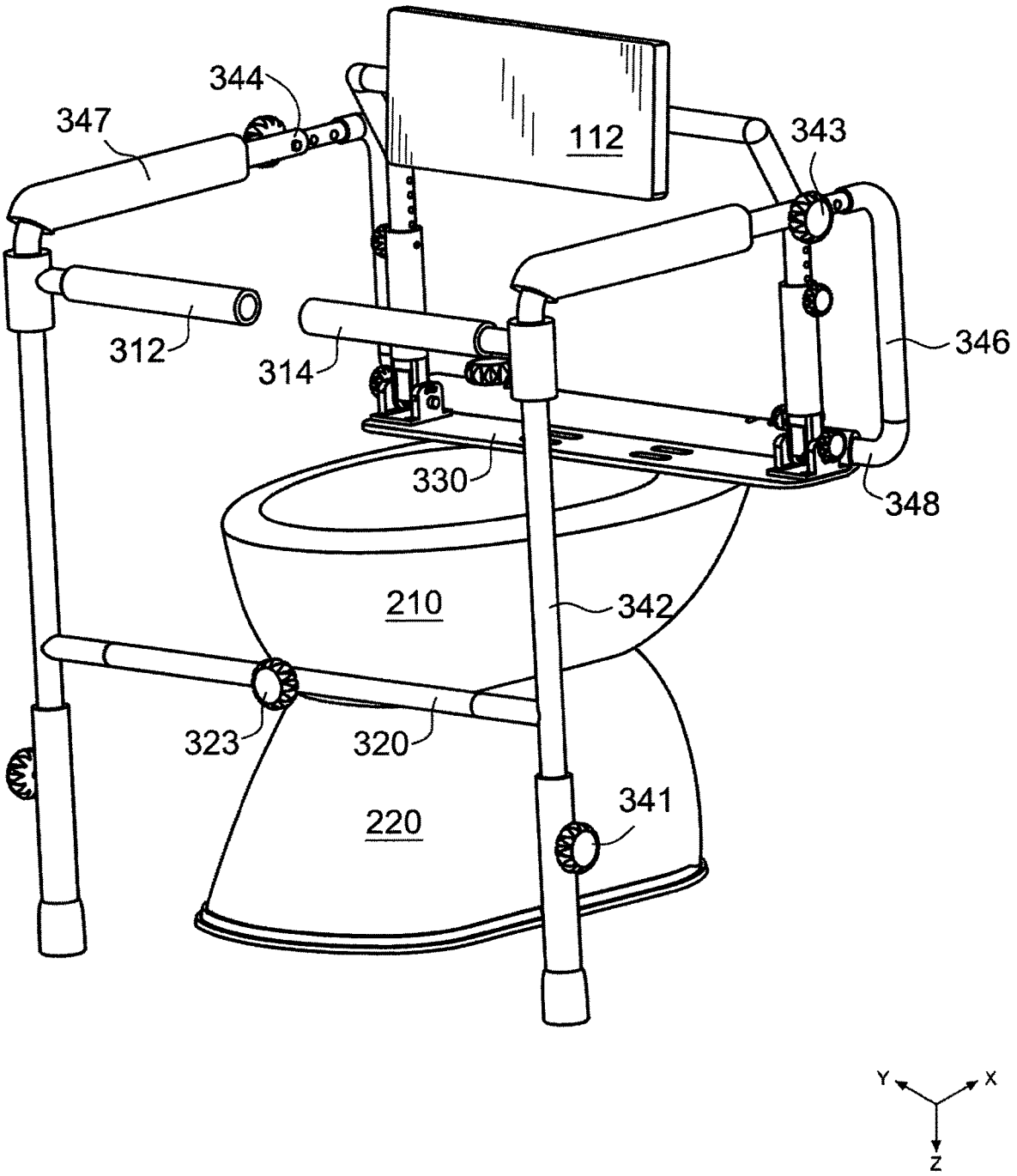
FIG. 8 is a perspective view of one example of the assistive apparatus, wherein the assistive apparatus placed over a toilet base and toilet bowl according to one embodiment of the invention.

FIG. 8 is a perspective view of one example of the assistive apparatus 300, wherein the assistive apparatus 300 placed over a toilet base 220 and toilet bowl 210 according to one embodiment of the invention. The assistive apparatus 300 with rotatable grab bar can be attached to a conventional toilet, commonly found in residential, commercial, and institutional environments, with the supporting mounting base 330.

The assistive apparatus 300 can be placed directly over a rim of a toilet bowl, a seat of a toilet seat system, a shower chair or a bedside commode. In one embodiment, as shown in FIG. 8, the assistive apparatus 300 placed over a toilet base 220 and toilet bowl 210 is an example of use. For example, an individual person may rotate the left bar 314 or right bar 312 up to 360 degree and locks into any place at a horizontal position. This allows the users to use the grab bar assembly 310 from multiple positions, or transfer himself between a toilet and another sitting apparatus.

Figure 9:
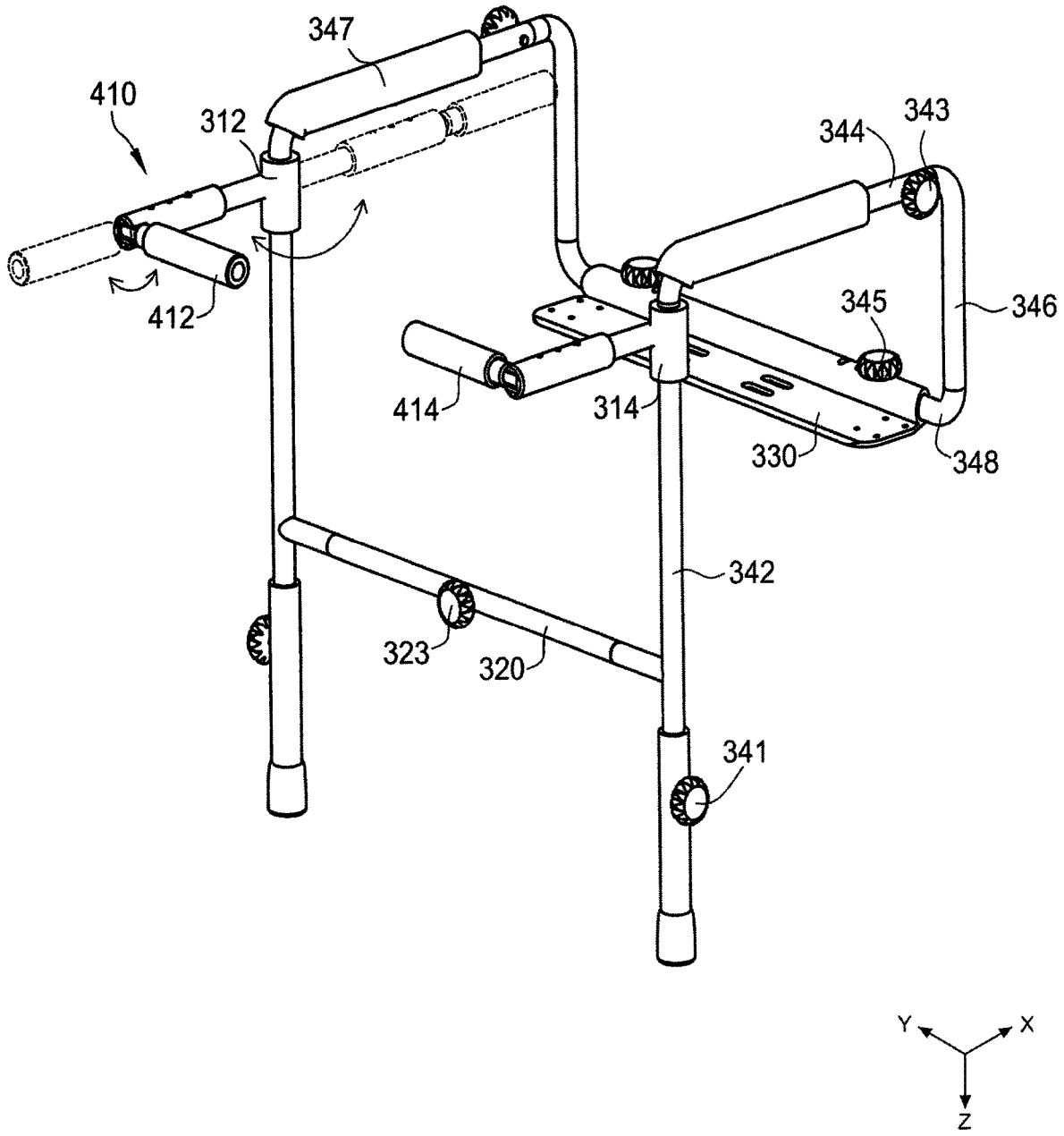
FIG. 9 is a perspective view of one example of operating a foldaway handle assembly, wherein the foldaway handle is capable of folding away and rotating according to one embodiment of the invention.

FIG. 9 is a perspective view of one example of operating a foldaway handle assembly 410, wherein the foldaway handle is capable of folding away and rotating according to one embodiment of the invention. The assistive apparatus 300 may further includes a foldaway handle assembly 410 comprising two handles 412 & 414.

In one embodiment, as shown in FIG. 9, the foldaway handle assembly 410 is connected to the upper support 344 of the supporting leg assembly 340 via the bar 312 & 314. This connection allows the foldaway handle assembly 410 to rotate in 360 degrees. Two handles 412 & 414 replace the original grab bar and serve as grips for a user to pull himself up.

Figure 10A:
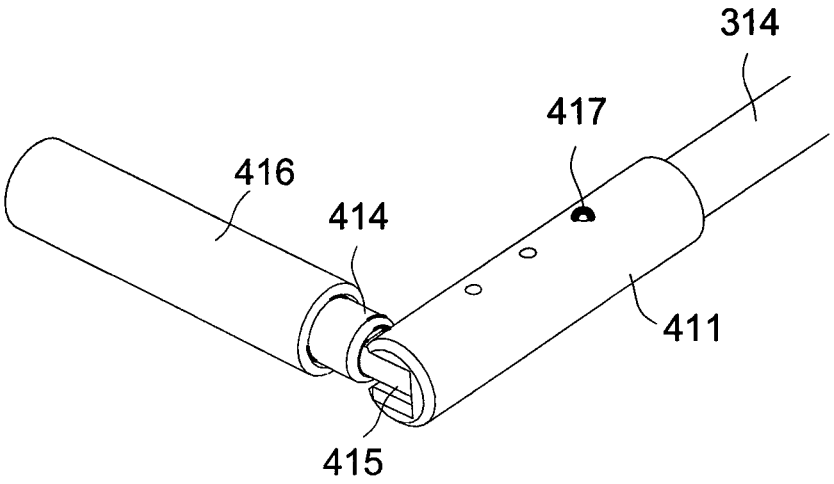
FIG. 10A is a sectional view of one example of the foldaway handle assembly at a folded position according to one embodiment of the invention.

FIG. 10A is a sectional view of one example of the foldaway handle assembly 410 at a folded position according to one embodiment of the invention. The foldaway handle assembly 410 comprising a bar connector 411, a right handle 412 and a left handle 414, a folding mechanism 415, a grip cushion 416 and a spring button 417.

In one embodiment, as shown in FIG. 10A, the foldaway handle assembly 410 is connected to the left bar 314 of the grab bar assembly 310. This connection allows the foldaway handle assembly 410 to rotate in 360 degrees. The handle 414 replace the original grab bar and serve as grips for a user to pull himself up.

For example, an individual could turn the left handle 414 to the right in 90 degrees to provide horizontal support or vertical support for elderly or disable users.

FIG. 108 illustrates a sectional view of another example of operating a foldaway handle assembly 410 at a preset position, wherein the foldaway handle 414 is capable of folding away and rotating according to another embodiment of the invention.

Figure 10B:
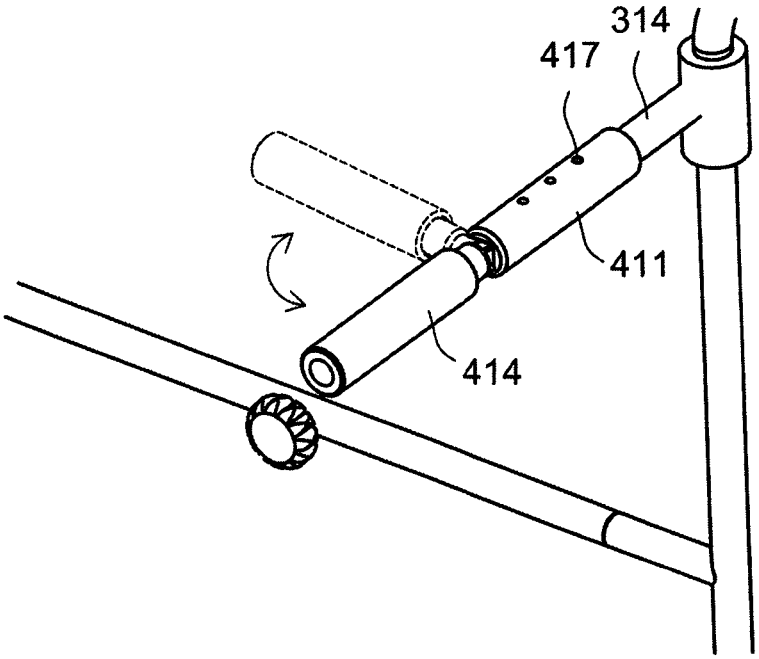
FIG. 10B is a sectional view of another example of operating a foldaway handle assembly at a preset position, wherein the foldaway handle is capable of folding away and rotating according to another embodiment of the invention.

In one embodiment, as shown in FIG. 10B, the foldaway handle assembly 410 is connected to the left bar 314 of the grab bar assembly 310. This connection allows the foldaway handle assembly 410 to rotate in 360 degrees. The handle 414 replace the original grab bar and serve as grips for a user to pull himself up.

For example, an individual could turn the left handle 414 to the right in 90 degrees to provide horizontal support or vertical support for elderly or disable users.

Figure 10C:
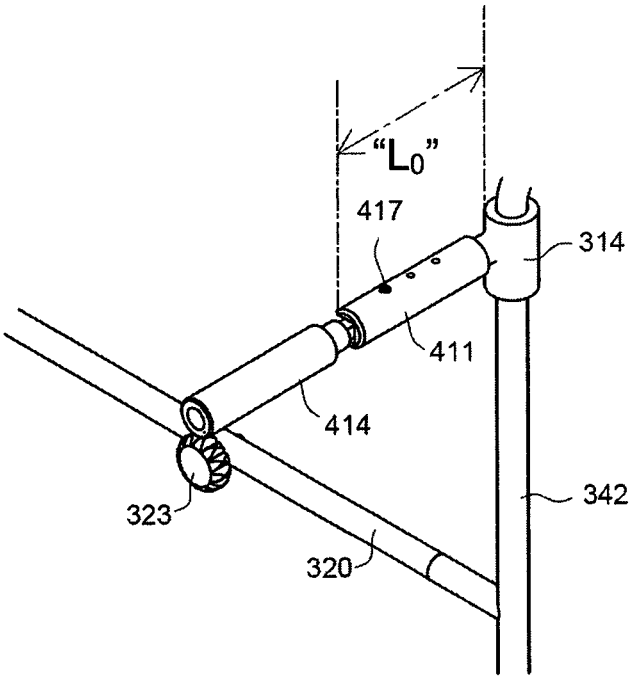
FIG. 10C is a sectional view of one example of a retracted foldaway handle assembly at a preset position (e.g., at $L_0$) according to one embodiment of the invention.

FIG. 10C illustrates a sectional view of one example of a retracted foldaway handle assembly 410 at a preset position (e.g., at $L'_0$) according to one embodiment of the invention, wherein the extension of the foldaway handle assembly 410 is shown.

In one embodiment, as shown in FIG. 10C, the spring button 417 is close to the top of the bar connector 411, and the distance between the castellated collar 311 and the handle 412 is "$L'_0$" which is the minimum length of the extension. On contrast, the spring button 417 is at the bottom of the bar connector 411 and the distance between the castellated collar 311 and the handle 412 is "$L'_1$", which represents the maximum length of the extension.

For example, an individual person may press the spring button 417, the bar connector 411 will be released and able to extend.

Figure 10D:
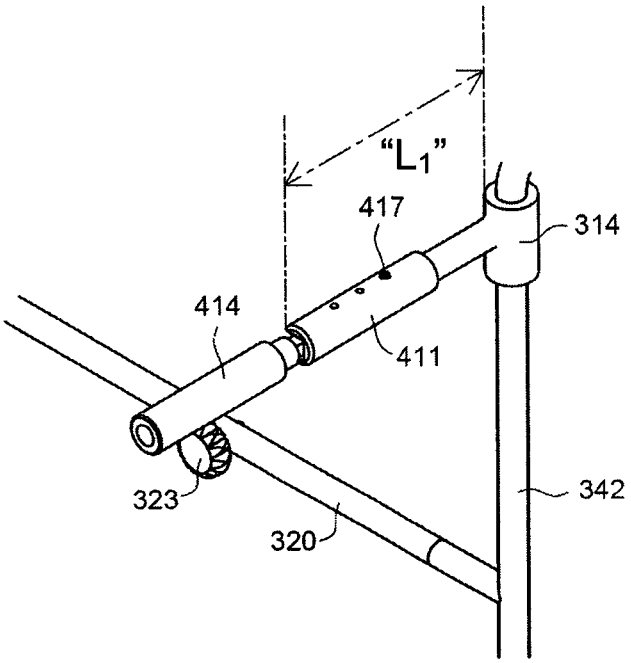
FIG. 10D is a sectional view of another example of an expanded foldaway handle assembly at a desired position (e.g., at $L_1$) according to one embodiment of the invention.

FIG. 10D illustrates a sectional view of another example of an expanded foldaway handle assembly at a desired position (e.g., at $L'_1$) according to one embodiment of the invention, wherein the extension of the foldaway handle assembly 410 is shown.

In one embodiment, as shown in FIG. 10D, the spring button 417 is at the bottom of the bar connector 411 and the distance between the castellated collar 311 and the handle 412 is "$L'_1$", which represents the maximum length of the extension. On contrast, the spring button 417 is close to the top of the bar connector 411, and the distance between the castellated collar 311 and the handle 412 is "$L'_0$" which is the minimum length of the extension.

For example, an individual person may press the spring button 417, the bar connector 411 will be released and able to extend.

Figure 11:
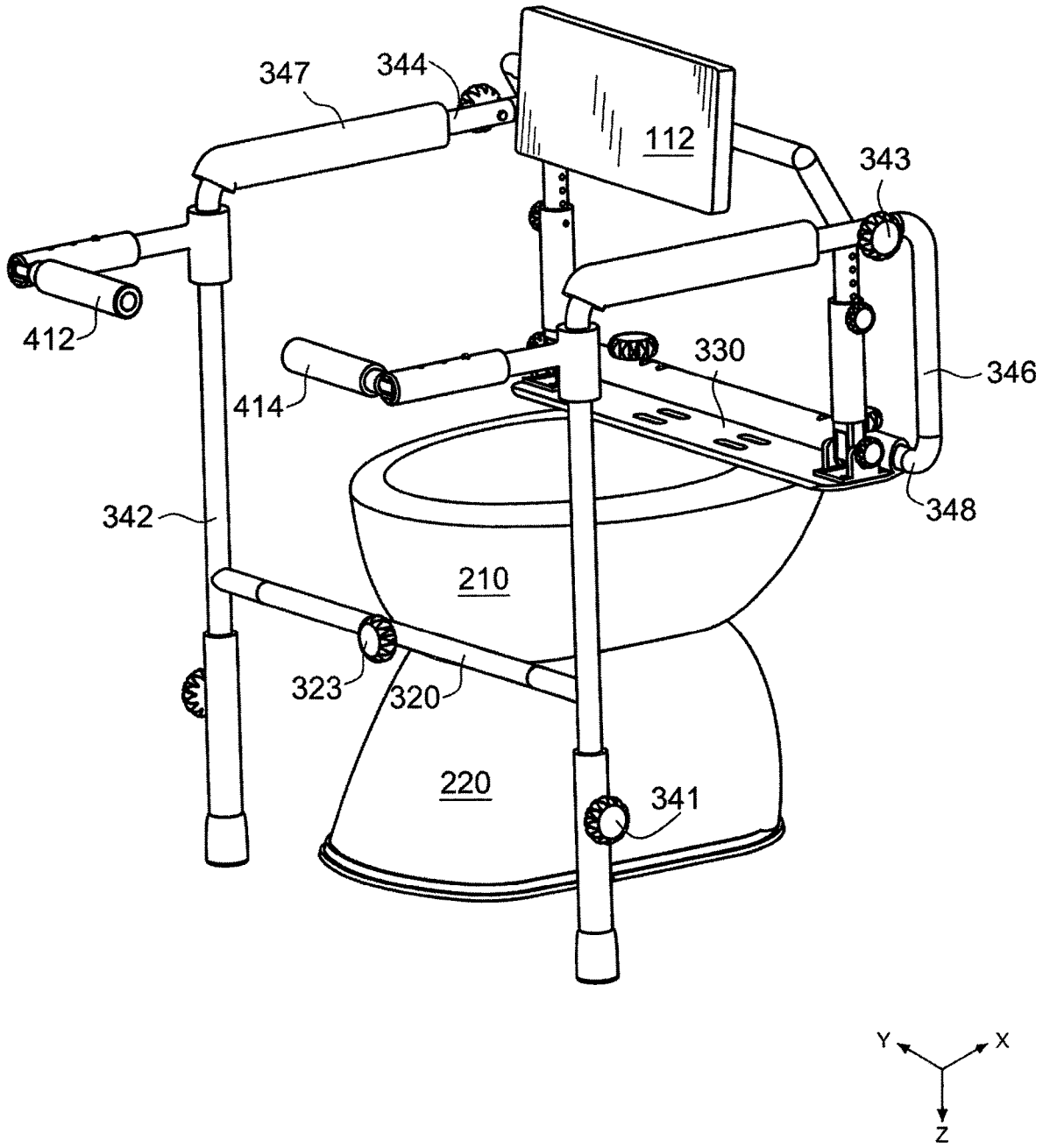
FIG. 11 is a perspective view of one example of a foldaway handle model of an assistive apparatus with rotatable grab bar and a toilet according to one embodiment of the invention.

FIG. 11 illustrates a perspective view of one example of a foldaway handle model of an assistive apparatus 300 with rotatable grab bar assembly 310, a foldaway handle assembly 410, and a toilet (a toilet base 220 and a toilet bowl 210) according to one embodiment of the invention. In one embodiment, the assistive apparatus 300 with foldaway handle can be attached to a conventional toilet, commonly found in residential, commercial, and institutional environments, with the supporting mounting base 330. The assistive apparatus 300 can be placed directly over a rim of a toilet bowl, a seat of a toilet seat system, a shower chair or a bedside commode.

In another embodiment, as shown in FIG. 11, the assistive apparatus 300 placed over a toilet base 220 and toilet bowl 210 is an example of use.

In still another embodiment, an individual person may press the spring button 417, the bar connector 411 will be released and able to extend. Therefore, foldaway handle assembly 410 is capable of providing horizontal support or vertical support for elderly or disable users.

Figure 12:
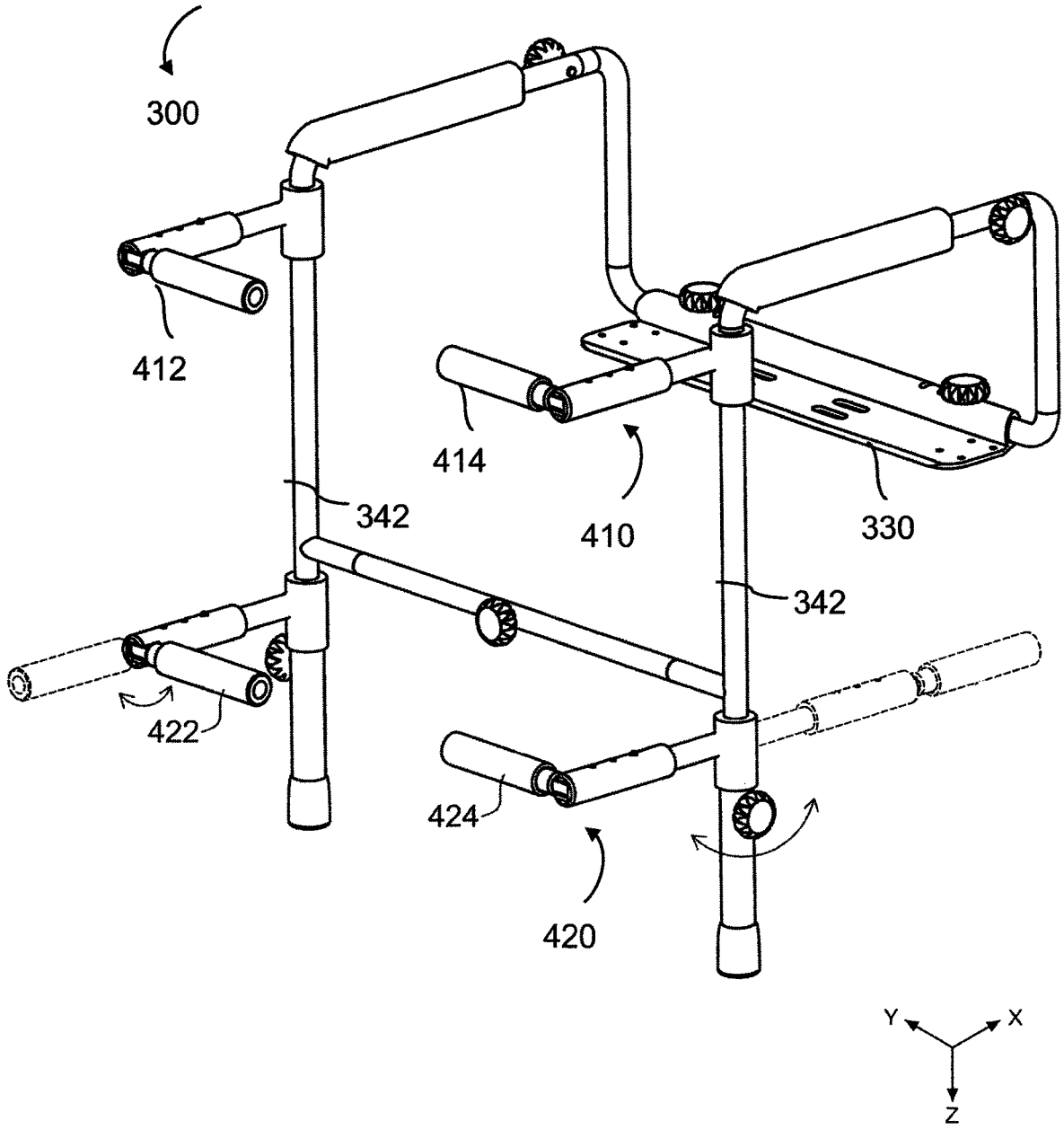
FIG. 12 is a perspective view of one example of a foldaway model of an assistive apparatus with a rotatable foot rest bar assembly according to one embodiment of the invention.

FIG. 12 illustrates a perspective view of one example of a foldaway model of an assistive apparatus 300 with rotatable foot rest bar assembly 420, rotatable grab bar assembly 310, and a foldaway handle assembly 410, according to one embodiment of the invention.

In one embodiment, the assistive apparatus 300 with rotatable foot rest bar assembly 420 can be attached to a conventional toilet, commonly found in residential, commercial, and institutional environments, with the supporting mounting base 330. The assistive apparatus 300 can be placed directly over a rim of a toilet bowl, a seat of a toilet seat system, a shower chair or a bedside commode.

In another embodiment, as shown in FIG. 12, the foot rest bar assembly 420 is connected to the left bar 314 of the grab bar assembly 310. This connection allows the foot rest bar assembly 420 to rotate in 360 degrees. The foot rest bar 424 designed to provide foot support for a user.

For example, an individual could turn the left foot rest bar 424 or right foot rest bar 422 to a desired position up to 360 degrees to provide foot support for elderly or disable users.

The invention claimed is:

1. An assistive apparatus, comprising:

a support frame mounting base;

a supporting leg assembly comprising:

two or more front support;

two or more upper support; and two knobs connected to the support frame mounting base via one or more base support;

a grab bar assembly comprising one or more grab bars connected to any one of the two or more upper support of the supporting leg assembly, wherein the one or more grab bar is capable of rotating in 360 degrees at a horizontal plane;

a foldaway handle assembly comprising a folding mechanism, a bar connector, one or more handles, one or more spring buttons, and one or more grip cushions; and a foot bar rest bar assembly comprising a folding mechanism, a bar connector, one or more foot rest bars, one or more spring buttons, and one or more grip cushions.

2. The assistive apparatus of claim 1, wherein the one or more grab bars are connected to the two front support of the supporting leg assembly via one or more castellated collars.

3. The assistive apparatus of claim 1, wherein the one or more grab bars comprising:

a left grab bar;

a right grab bar.

4. The assistive apparatus of claim 1, further comprising:

one or more knobs connected to the supporting leg assembly, wherein the one or more adjust knobs are adapted to adjust the length between a first place ("$L_0$") at a horizontal position to a second place ("$L_1$") at a horizontal position.

5. The assistive apparatus of claim 1, further comprising:

one or more knobs connected to a front bar, wherein the one or more knobs are adapted to adjust the width between a first place ("$W_0$") to a second place ("$W_1$") consist with the extension of the supporting leg assembly.

6. The assistive apparatus of claim 1, further comprising:

one or more knobs connected to the two or more front support, wherein the one or more knobs are adapted to adjust the height of the two or more front support between a first place ("$H_0$") to a second place ("$H_1$") consist with the extension of a rear support.

7. The assistive apparatus of claim 1, further comprising:

the support frame mounting base connected between the supporting leg assembly and any sitting apparatus to be used.

8. The assistive apparatus of claim 1, further comprising:

one or more rear bar assembly connected to the supporting leg assembly.

9. The assistive apparatus of claim 1, wherein the foldaway handle assembly further comprising:

a right handle;

a left handle;

the one or more spring buttons are at the bottom of the bar connector, wherein the bar connector could be released or extended via pressing the one or more spring buttons; and the foldaway handle assembly is connected to the grab bar assembly, wherein the right handle or left handle is capable of rotating in 360 degrees.

10. The assistive apparatus of claim 1, wherein the foot rest bar assembly further comprising:

a right foot rest bar;

a left foot rest bar;

the one or more spring buttons are at the bottom of the bar connector, wherein the bar connector could be released or extended via pressing the one or more spring buttons;

the foot rest bar assembly is connected to the grab bar assembly, wherein the right foot rest bar or left foot rest bar is capable of rotating in 360 degrees.

11. The assistive apparatus of claim 2, wherein the one or more grab bars are covered with one or more grip cushions.

12. The assistive apparatus of claim 9, wherein the left or the right handle is capable of turning in 90 degrees to provide horizontal support or vertical support.

13. The assistive apparatus of claim 10, wherein the left or right foot rest bar is capable of turning in 90 degrees to provide horizontal support or vertical support.

* * * * *